US005772559A

United States Patent [19]

Sithole

[11] Patent Number: 5,772,559

[45] Date of Patent: Jun. 30, 1998

[54] MODULAR AEROBIC-EXERCISE STEPPER

[76] Inventor: Deborah Sithole, 241-20 Northern Blvd., Apt. C, Douglaston, N.Y. 11362

[21] Appl. No.: 651,917

[22] Filed: May 21, 1996

[51] Int. Cl.[6] ..... A63B 5/00

[52] U.S. Cl. ..... 482/52; 482/51

[58] Field of Search ..... 482/51, 52, 53; 248/188.2; 297/461–462, 438; 108/91, 93, 901

[56] References Cited

U.S. PATENT DOCUMENTS

| | | | |
|---|---|---|---|
| 2,500,425 | 3/1950 | Morris | 482/51 |
| 4,253,661 | 3/1981 | Russell | 482/51 |
| 5,108,089 | 4/1992 | Wilkinson | 482/52 |
| 5,354,247 | 10/1994 | Wilkinson | 482/52 |
| 5,540,638 | 7/1996 | Wilkinson | 482/51 |

*Primary Examiner*—Jerome Donnelly
*Attorney, Agent, or Firm*—Chris A. Caseiro; Thomas L. Bohan

[57] ABSTRACT

A stepper for use during aerobic stepping exercises. The invention has modular platforms that allow for one or more platforms to be stacked upon a base platform. The platform is placed on the base in a pyramid-like manner forming steps in every direction surrounding the stepper so that the user may step from one platform to another in any direction. Interlocking slots and ridges are formed on opposing surfaces of each platform and the base to provide stability during use. A non-slip coating on all opposing surfaces and on the step surfaces to provide additional stability. An optional one-piece cap is provided as a top surface which is also non-slip.

5 Claims, 3 Drawing Sheets

MODULAR AEROBIC-EXERCISE STEPPER

BACKGROUND OF THE INVENTION

1. Field of the Invention

The present invention relates to exercise devices. More specifically, this invention relates to modular exercise devices for elevated stepping used during aerobic exercising.

2. Background of the Invention

Adjustable stepping platforms are known in the exercise device art. Such stepping platforms are utilized in the performance of various aerobic exercise routines. These exercise routines typically involve stepping, jumping, or hopping movements. Commonly termed "aerobics," these exercise routines are performed by an individual through elevated leg movements. The exercise routines involve basic movements initially and tend to become more complex according to the level of exercise instruction. As the complexity of the movements increases, the versatility of the adjustable stepping platforms used is pushed to the limits. Individuals may need to re-adjust or re-configure the adjustable stepping platform. Protracted periods of stepping-platform adjustment occurs when the mechanics of adjusting the stepping platform is involved and complex. The interruption necessitated by stepper platform readjustment and resultant delay in exercising adversely affects the healthful aerobic effect of the exercise routine.

Several prior-art devices exist which attempt to alleviate exercise-related problems as noted above. The device of Wilkinson (U.S. Pat. No. 5,354,247) shows a modular step exercise unit that includes a plurality of individual steps. Wilkinson teaches a design having platforms stackable upon one another during use and stackable within one another during storage. These platforms are of varying lengths so as to provide a multi-level step arrangement. However, the width of each of these platforms remains substantially identical so that any user of the Wilkinson platform can only step up at progressively increasing heights from one direction. Any change in the stepping direction by the user requires the Wilkinson device to moved, thus interrupting aerobic exercise. Another more basic adjustable stepping platform, also described by Wilkinson, (U.S. Pat. No. 5,108,089) (Wilkinson II). Wilkinson II includes an adjustable feature that is incorporated into support legs which may be adjusted so as to alter the height of the stepping platform. This stepping platform is of limited use in any exercise routine requiring multiple step elevations.

The device of Goldstein et al. (U.S. Pat. No. 5,213,554) is a stepper having adjustable feet incorporated into supports which may be adjusted so as to alter the height of the stepping platform, albeit by only providing one step-level at a time. The device of Irwin (U.S. Pat. No. 5,318,489) is a stepping platform with features similar to both Wilkinson devices. The design taught by Irwin includes stackable support sections that change the level of the main stepping platform. The resultant stepping platform is thus adjustable in height but fails to provide a user with concurrent multiple elevations. Similarly, the device of Ullman (U.S. Pat. No. 5,176,596) is a three-position stepping platform. The device of Ullman has two pieces which are adjustably arranged to provide three levels of elevation. However, at any given moment, the platform is only capable of one particular level. Accordingly, a user would have to constantly readjust the Ullman stepping platform as desired and could not utilize this design for exercise routines that required stepping movements of increased elevations. The device of Adamczyk et al. (U.S. Pat. No. 5,154,678) is a stepping platform which is similar to the stackable support sections of Irwin except that the entire platform of Adamczyk et al. is effectively a stackable support section. Adamczyk et al. is also adjustable but maintains only one platform level at any given moment. The device of Thomas et al. (U.S. Pat. No. 5,050,861) is an adjustable exercise step of a design that incorporates one box and one slightly smaller inverted box to form a generally rectangular enclosure. The box-like design of Thomas et al. has a platform that is adjustable to a variety of heights but only one level at a time.

None of the prior-art devices provides a stepping platform having multiple platform levels which may be utilized by more than one direction without adjustment. The prior-art devices fail to provide a multi-level stepper platform that permits the user to step from one level to another in any direction—front, back, right side, left side. Therefore, what is needed is a stepping platform that provides individual steps of varying widths and lengths. Such a desired stepping platform should include an adjustment arrangement designed to enable a user to create and readjust various stepping platform configurations quickly and easily. What is also needed is such a stepping platform that permits movement from one level to another in multiple directions.

SUMMARY OF THE INVENTION

Accordingly, it is an objective of the present invention to provide a stepping platform for exercising that is useful during a variety of aerobic exercise routines. It is a further object of the present invention to provide a stepping platform utilizing individual steps of ever-decreasing length and width in a block pyramid-like fashion. Yet further, it is an object of the present invention to provide such a device that is lightweight and durable. As well, it is an object of the present invention to provide an easily-adjustable stepper.

These objectives are accomplished by a modular aerobic-exercise stepper apparatus in accordance with preferred embodiments of the present invention. The apparatus includes multiple platforms that, during use, are stacked in a pyramid-like fashion. Such platforms may be made from a variety of materials including, but not limited to, plastic, rubber, wood, and metal. Coupling between the platforms is accomplished via interlocking slots and grooves. The slots and ridges maintain the platforms in a stacked position. In contrast to prior-art designs, the sections of the present modular aerobic-exercise stepper apparatus are advantageously made of few pieces, which assists in the ease of manufacture. The stepper may be fabricated of plastic or metal by injection molding, cold-press, or any suitable method of manufacture common in the art. Such fabrication enables various configurations of the present invention. A non-slip material is included on the top-most platform surface. Such a non-slip portion may include some type of ribbed design. The non-slip portion may also simply be a coating, such as porous rubber or a pumice-impregnated paint or any similar material, which would provide a high-friction surface. Such variations may be dependent upon the specific use and environment in which the stepper according to the present invention is used.

This simple yet innovative design shown by the preferred embodiment and referred to below by reference to the drawings is to be understood as merely representative. It will be clear to one skilled in the art from the following detailed description that various embodiments exist within the scope of the present invention without straying from the spirit of this invention.

DESCRIPTION OF THE PREFERRED EMBODIMENT

Figure 1:
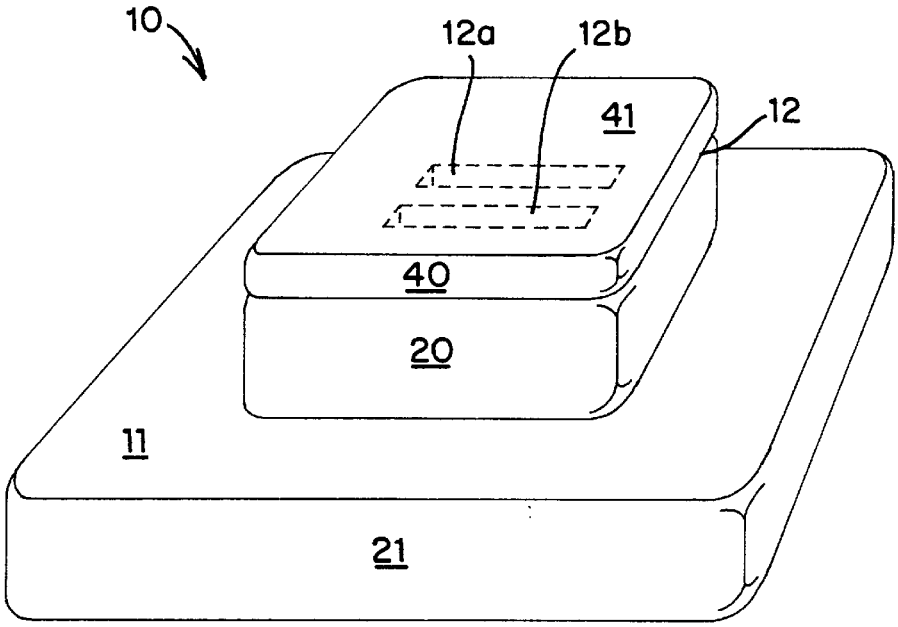
FIG. 1 is a perspective view of the stepper according to the present invention.
Figure 1A:
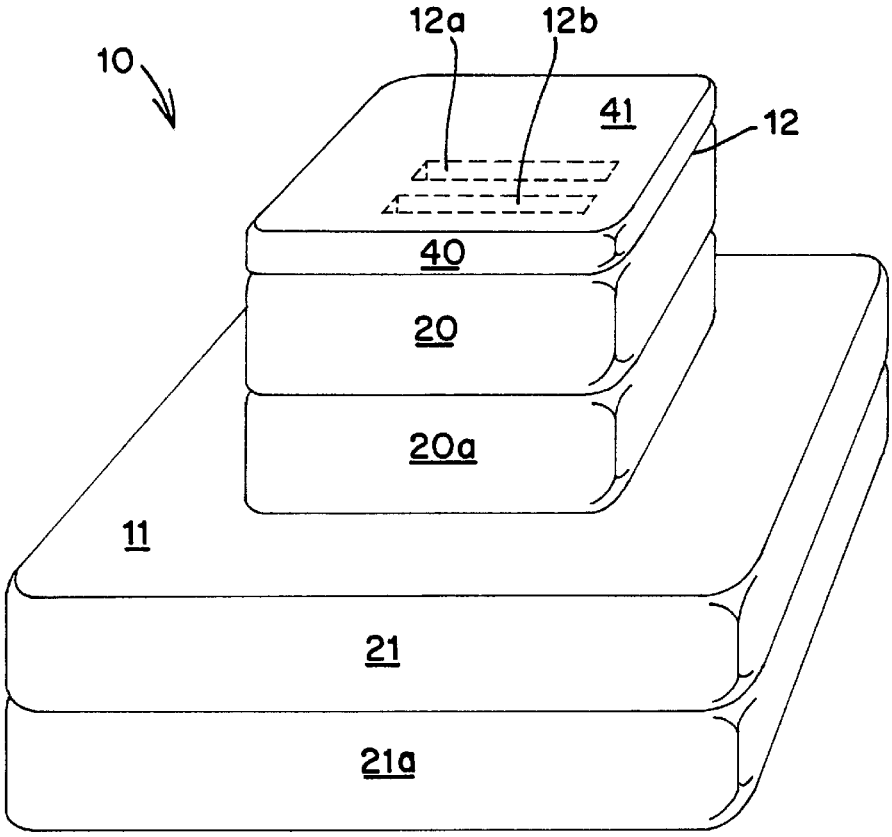
FIG. 1A is a perspective view of an alternative embodiment of the stepper according to the present invention, showing two equally-sized bases and two equally-sized platforms.

In reference to FIG. 1, there is shown a modular aerobic-exercise stepper 10 of the present invention that includes a lower step surface 11 of a lower base 21 and an upper step surface 12 of an upper platform 20. Although only two step surfaces are shown in FIG. 1, it should be understood that more than two surfaces may be possible without straying from the scope of the present invention. Upper slots 12*a* and 12*b* are shown in upper step surface 12. FIG. 1A illustrates an alternative embodiment of the present invention as a stepper 10' of greater overall height than the stepper 10 shown in FIG. 1. In particular, the stepper 10' includes a pair of essentially equally-sized base components, first base 21 and second base 21*a*, and a pair of essentially equally-sized platforms, first upper platform 20 and second upper platform 20*a*. Of course, as with the stepper 10 shown in FIG. 1, the alternative stepper 10' of FIG. 1A the first upper platform 20 and the second upper platform 20*a* are sized to be smaller in length and width dimensions than first base 21 and second base 21*a* as described more fully herein. It is to be noted that the optional design of FIG. 1A may be further modified so that only one base and two equally-sized platforms may be used together, or two equally-sized bases and a single platform may be used together. In this way, the person exercising may vary the difficulty of upward and downward movement by changing the height of the stepper 10'.

Figure 2:
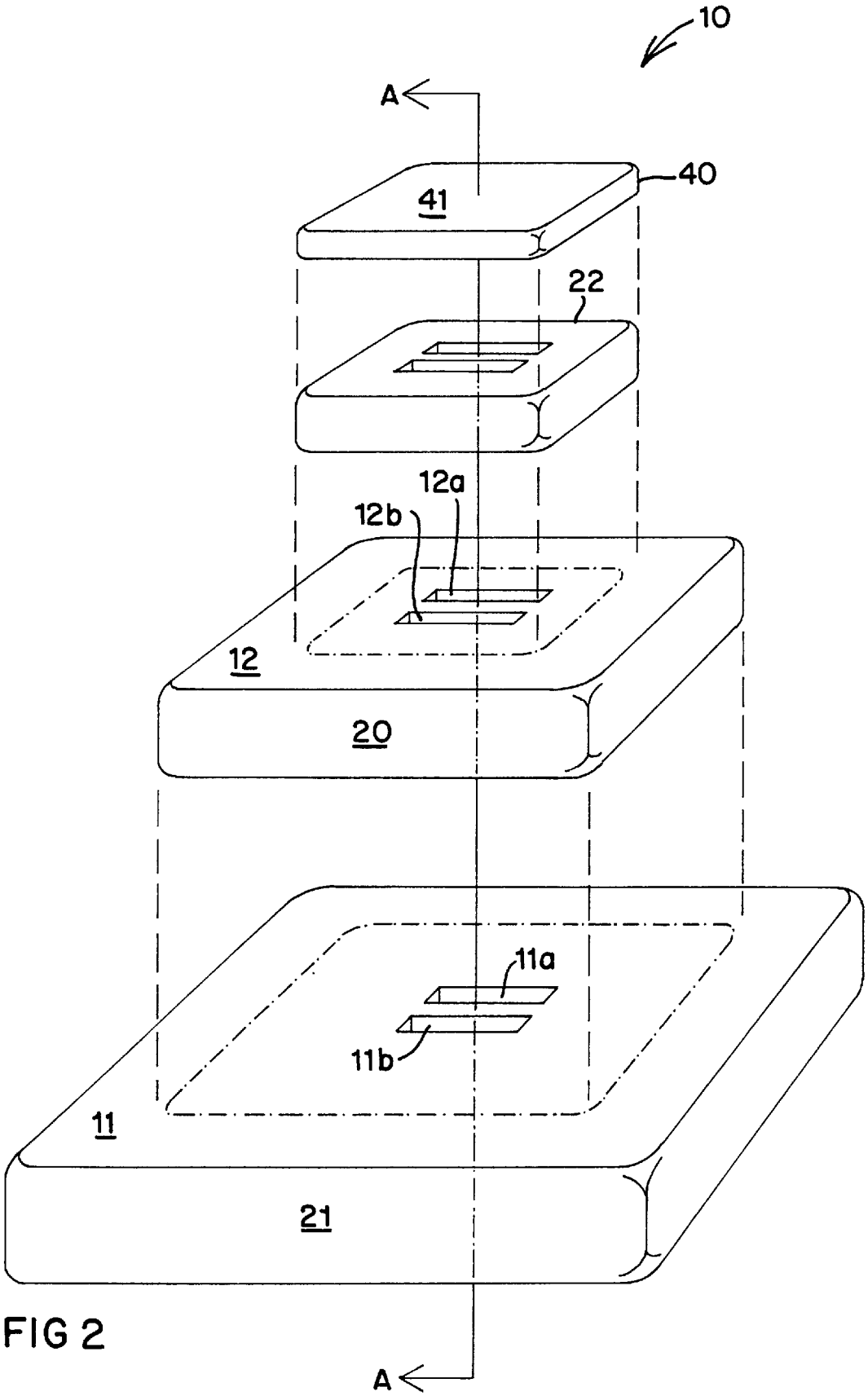
FIG. 2 is an exploded view of the stepper with the base and two platform sections shown according to another embodiment according to the present invention.

With additional reference to FIG. 2, there is shown the stepper 10 as seen in FIG. 1 but with one additional platform 22, and disassembled. From FIG. 2 it is readily seen that the upper platform 20 is centered upon the lower base 21 in order to form a stepped configuration that creates the lower step surface 11 and the upper step surface 12. The upper platform may include additional platforms (not shown) that are centered upon one another in a fashion similar to the relation between upper platform 20 and lower base 21. Lower slots 11*a* and 11*b* are shown in the lower step surface 11 that is beneath the upper platform 20. These lower slots 11*a* and 11*b* interlock with upper ridges 12*c* and 12*d* of upper platform 20 as shown in FIG. 3.

Figure 3:
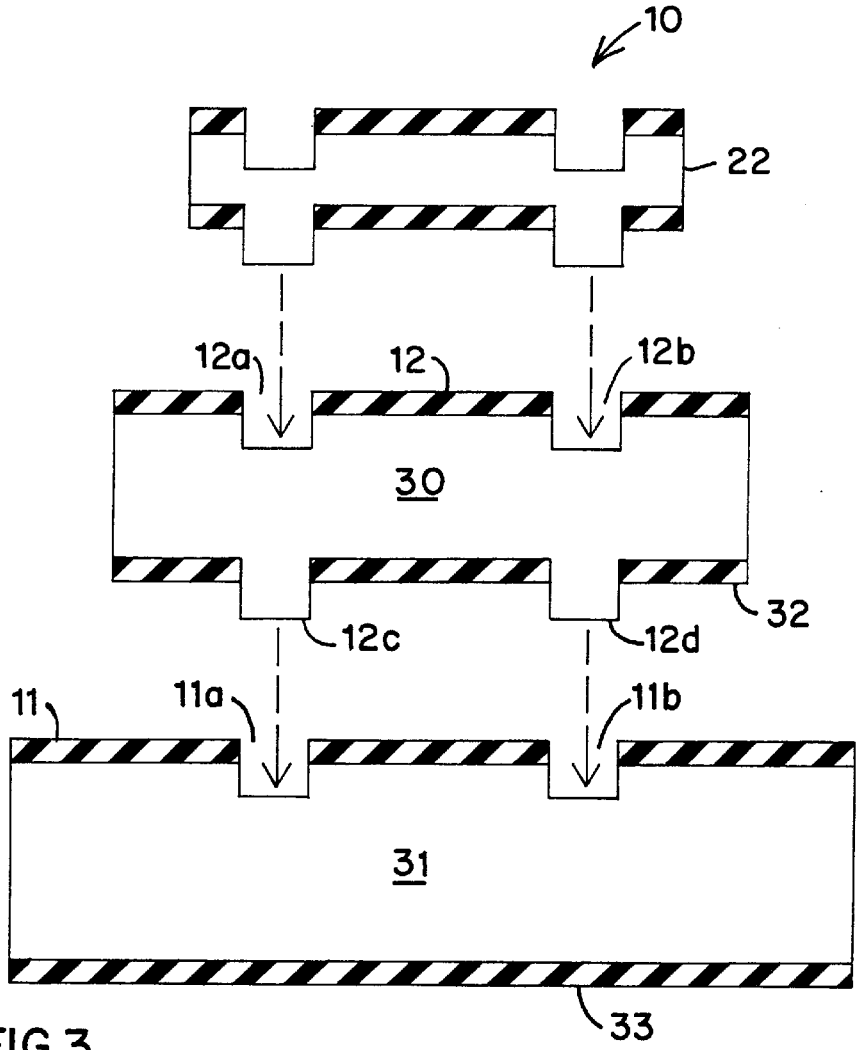
FIG. 3 is a cut-away and exploded side view of the base and one platform of the stepper according to the present invention.

FIG. 3 is a side-view cross-section taken along line A—A in FIG. 2. From FIG. 3, the interlocking configuration of lower slots 11*a* and 11*b* with upper ridges 12*c* and 12*d* can be seen. As mentioned before, additional platforms may be utilized without straying from the scope of the present invention. The first of such additional platforms would include raised ridges that would interlock with upper slots 12*a* and 12*b* of upper platform 20 in the same manner that the upper platform 20 interlocks with the lower base 21. Additional platforms may be of similar dimensions to platforms immediately beneath each platform. This would effectively raise the height between upper step surface 12 and lower step surface 11. Alternatively, additional platforms may be of smaller dimensions in a proportion similar to the pyramid-like proportions seen in FIG. 1. Such a multi-tiered pyramid-like configuration would provide additional steps.

With continuing reference to FIG. 3, it can be seen that lower step surface 11 and upper step surface 12 are made of a material which is different from the cores 30 and 31 of upper platform 20 and lower base 21, respectively. Cores 30 and 31 are shown as each being a singular piece. Each may be made from a solid piece of wood, metal, or polymer, or any suitable material. Further, upper underside surface 32 and lower underside surface 33 are shown to be of a material similar to step surfaces 11 and 12. As shown, these surfaces 11, 12, 32, and 33 are all formed of a non-slip rubber. The non-slip properties of the rubber assure that lower base 21 remains firmly situated wherever it is placed. (e.g. upon concrete, wooden, or carpeted floors) The non-slip properties of the rubber ensure that upper underside surface 32 and lower step surface 11 do not slip with respect to one another. This prevents movement of upper platform 20 during use of the stepper 10.

It should be understood that additional platforms may be provided with non-slip surfaces in a similar manner. As well, the non-slip material is not limited to rubber. Numerous other materials may be used that are well within the scope of the present invention such as, but not limited to, paints or adhesive tapes that are impregnated with pumice or sand. Any alternative material may be chosen which provides sufficient friction to provide a non-slip surface. Such non-slip material should be applied liberally to all step surfaces. This provides a safety feature to the stepper 10 in that anyone using the stepper 10 during an exercise routine will have increased traction on the step surfaces 11 and 12.

Figure 4:
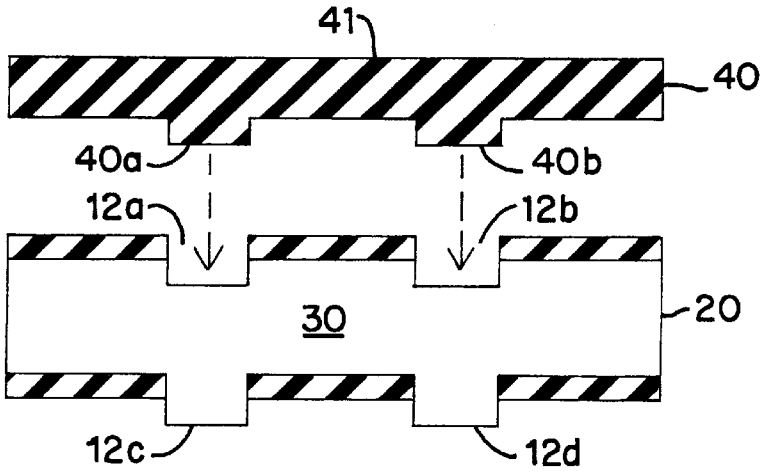
FIG. 4 is a cut-away and exploded side view of the top platform of another embodiment according to the present invention.

FIG. 4 shows an alternative top platform design. While the non-slip surface of upper step surface 12 may be sufficient for light to moderate use, FIG. 4 shows a heavy duty design for rigorous use. A cap 40 is shown with cap ridges 40*a* and 40*b* that interlock with upper slots 12*a* and 12*b* of upper platform 20. This design provides a top surface 41 that is uniform. As well, the entire cap 40 is made from a non-slip material. The cap 40 may be made from a stiff material with a high friction coating or may be made from a solid piece of rubber. Any suitable material which provides non-slip properties may be used.

It must be recognized that alternative materials and manufacture methods may be used as appropriate without straying from the scope of the instant invention. Though the preferred embodiment includes high-impact plastics which may be injection molded into an assortment of shapes and sizes, a variety of suitable materials may used. Accordingly, while the modular stepper has been described in connection with a particular embodiment thereof, the true scope of the invention should not be so limited since other modifications will become apparent to one skilled in the art in light of the specification and following claims.

I claim:

1. A modular stepper, comprising:

a) an upper platform having length and width dimensions; and b) a base having length and width dimensions greater than said length and width dimensions of said upper platform, such that when said upper platform is centrally located upon a top surface of said base, a portion of said top surface of said base surrounding said upper platform is exposed sufficient to permit a user to step on said portion from all directions surrounding said stepper, said base including two base slots located on said top surface of said base, and said upper platform including two upper ridges located on a platform bottom surface of said upper platform and two upper slots located on a platform top surface of said upper platform, where said base slots and said upper ridges are arranged to interlock and substantially secure said upper platform to said base, wherein a platform top surface of said upper platform, said top surface of said base, an upper underside surface of said upper platform and a lower underside surface of said base, are all covered with a non-slip rubber material.

2. The stepper as claimed in claim 1, further comprising:

a cap having a substantially planar cap surface made from said non-slip rubber material and and two cap ridges on a bottom cap surface of said cap where said cap ridges and said upper slots of said platform top surface are arranged to interlock and substantially secure said cap to said upper platform.

3. The stepper as claimed in claim 1, wherein:

said upper platform is a first platform, and said stepper further includes a second platform of substantially the same design as said first platform.

4. The stepper as claimed in claim 3, wherein:

said second platform is positionable on said first platform and wherein height and width dimensions of said first platform are greater than height and width dimensions of said second platform.

5. The stepper as claimed in claim 1, wherein:

said base is a first base, wherein said stepper further includes a second base positionable on said first base, and wherein said first base and said second base are essentially of equal size.

* * * * *